US006755180B2

(12) United States Patent
Ishida

(10) Patent No.: US 6,755,180 B2
(45) Date of Patent: Jun. 29, 2004

(54) DISTRIBUTION TYPE FUEL INJECTION PUMP

(75) Inventor: Hiroki Ishida, Nagoya (JP)

(73) Assignee: Denso Corporation, Kariya (JP)

( * ) Notice: Subject to any disclaimer, the term of this patent is extended or adjusted under 35 U.S.C. 154(b) by 44 days.

(21) Appl. No.: 10/319,468

(22) Filed: Dec. 16, 2002

(65) Prior Publication Data

US 2003/0111054 A1 Jun. 19, 2003

(30) Foreign Application Priority Data

Dec. 18, 2001 (JP) ..... 2001-384578
Oct. 2, 2002 (JP) ..... 2002-289913

(51) Int. Cl.[7] ..... F02M 37/04; F04B 23/10
(52) U.S. Cl. ..... 123/450; 123/500; 123/373
(58) Field of Search ..... 123/448, 449, 123/450, 451, 500, 501, 502, 372, 373, 495

(56) References Cited

U.S. PATENT DOCUMENTS 4,311,127 A * 1/1982 Mayer ..... 123/557
4,679,993 A * 7/1987 Haberland ..... 417/490
4,702,680 A * 10/1987 Bohringer et al. ..... 417/490
4,745,900 A * 5/1988 Thudt ..... 123/357
5,224,846 A * 7/1993 Kirschner et al. ..... 417/499
5,641,274 A * 6/1997 Kubo et al. ..... 417/206

FOREIGN PATENT DOCUMENTS

JP 4-1644 1/1992

* cited by examiner

*Primary Examiner*—Thomas N. Moulis
(74) *Attorney, Agent, or Firm*—Nixon & Vanderhye P.C.

(57) ABSTRACT

A chamfering portion provided at an inlet corner of a port of an inside way-out in a governor shaft is effective to decrease energy loss of fuel flowing into the inside way-out to less than one half in comparison with that of a conventional art. A flow amount characteristic of the fuel into the inside way-out improves so that a hysteresis between a pump chamber pressure decrease characteristic on increasing a load (a retarding characteristic) and a pump chamber pressure increase characteristic on decreasing the load (an advancing characteristic) is lowered, resulting in securing a highly accurate control of fuel injection timing.

1 Claim, 5 Drawing Sheets

DISTRIBUTION TYPE FUEL INJECTION PUMP

CROSS REFERENCE TO RELATED APPLICATIONS

This application is based on and incorporates herein by reference Japanese Patent Application Nos. 2001-384578 filed on Dec. 18, 2001 and 2002-289913 filed on Oct. 2, 2002.

FIELD OF THE INVENTION

The present invention relates to a distribution type fuel infection pump and, in particular, a load timer which accurately controls fuel injection timing with a deduced hysteresis between an advancing and delaying timings.

BACKGROUND OF THE INVENTION

A conventional governor that defines performance of a load timer is explained. A governor shaft is provided with an inside way-out whose one end opens to outer circumference thereof and whose the other end communicates with a low fuel pressure side such as a fuel tank. A governor sleeve is provided with an outside way-out which penetrates from an outer surface thereof to an inner surface thereof in sliding contact with the governor shaft. When the governor sleeve advances (in a low load), the inside and outside way-outs communicate with each other. When the governor sleeve backs (in a high load), the communication between both the way-outs are shut off. The above conventional load timer has a characteristic that injection timing is retarded as the pump chamber is depressurized in the low load, as shown in FIG. 2B, and the injection timing is advanced as the pump chamber is pressurized in the high load.

Further, there is known a load timer that has a different characteristic. When the governor sleeve advances (in a low load), the communication between the inside and outside way-outs is shut off so that the pump chamber can be pressurized. When the governor sleeve backs (in a high load), both the way-outs communicate with each other so that the chamber can be depressurized. This structure provides an inverse advancing and retarding characteristic as shown by a solid line A and a dotted line J in FIG. 2A. This characteristic improves an ignition characteristic by advancing injection timing in the low load and upgrades an exhaust characteristic by retarding the injection timing in the middle and high load. This inverse advancing and retarding characteristic is disclosed in JP-U-H4-1644.

Recently a social background has involved a stringent emission limit of a diesel engine, so a highly accurate fuel injection pump is desired. However, a fuel injection pump that has the inverse advancing and retarding characteristic (inverse characteristic load timer) exhibits a hysteresis between a retarding characteristic while the load increases (dotted line J shown in FIG. 2A) and an advancing characteristic while the load decreases (solid line B shown in FIG. 2A) . This hysteresis adversely affects on a highly accurate advancing and retarding control (injection timing control).

SUMMARY OF THE INVENTION

It is an object of the present invention to provide a distribution type fuel injection pump in which an accuracy of fuel injection timing is enhanced by decreasing a hysteresis between a retarding characteristic while a load increases and an advancing characteristic while the load decreases.

To achieve the above and other objects, a distribution type fuel injection pump is provided with a governor as follows: The governor includes a governor shaft and a governor sleeve. An inner surface of the governor sleeve is slidably fitted to an outer circumference of the governor shaft. An inside way-out is provided in the governor shaft and includes a first shaft port, a second shaft port and an annular groove. The first shaft port is axially formed in a center of the governor shaft, and one end of the first shaft port communicates with a suction side of the pump, while the other end of the first shaft port is sealed. The annular groove formed in the outer circumference of the governor shaft faces the inner surface of the governor sleeve. The second shaft port extends in a radial direction of the governor shaft across the first shaft port and an inlet of the second shaft port opens to a bottom of the annular groove. An outside way-out is provided in the governor sleeve. One end of the outside way-out opens in the inner surface of the governor sleeve and faces the outer circumference of the governor shaft. And the other end of the outside way-out communicates with the pump chamber. When the governor sleeve advances, the communication between the inside and outside way-outs is shut off and the communication between the suction side of the pump and the pump chamber is shut off. The fuel pressure in the pump chamber is thereby increased. When the governor sleeve backs, both the way-outs communicate with each other and both of the suction side of the pump and the pump chamber are communicated with each other. The fuel pressure in the pump chamber is thereby decreased. And one of a chamfering portion formed by cutting off flatly a corner and a rounding portion formed by rounding a corner is provided in the inlet of the second shaft port that opens to the bottom of the annular groove.

The above chamfering/rounding portion in the inlet of the second shaft port of the inside way-out decreases energy loss caused by fuel flowing into the inside way-out and improves a flow characteristic of the fuel. This improvement restrains a hysteresis between pump chamber pressure decrease while the load increases and pump chamber pressure increase while the load decreases. This thereby results in lowering a hysteresis between a retarding characteristic while the load increases and an advancing characteristic while the load decreases, and securing a highly accurate fuel infection timing control.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 4:
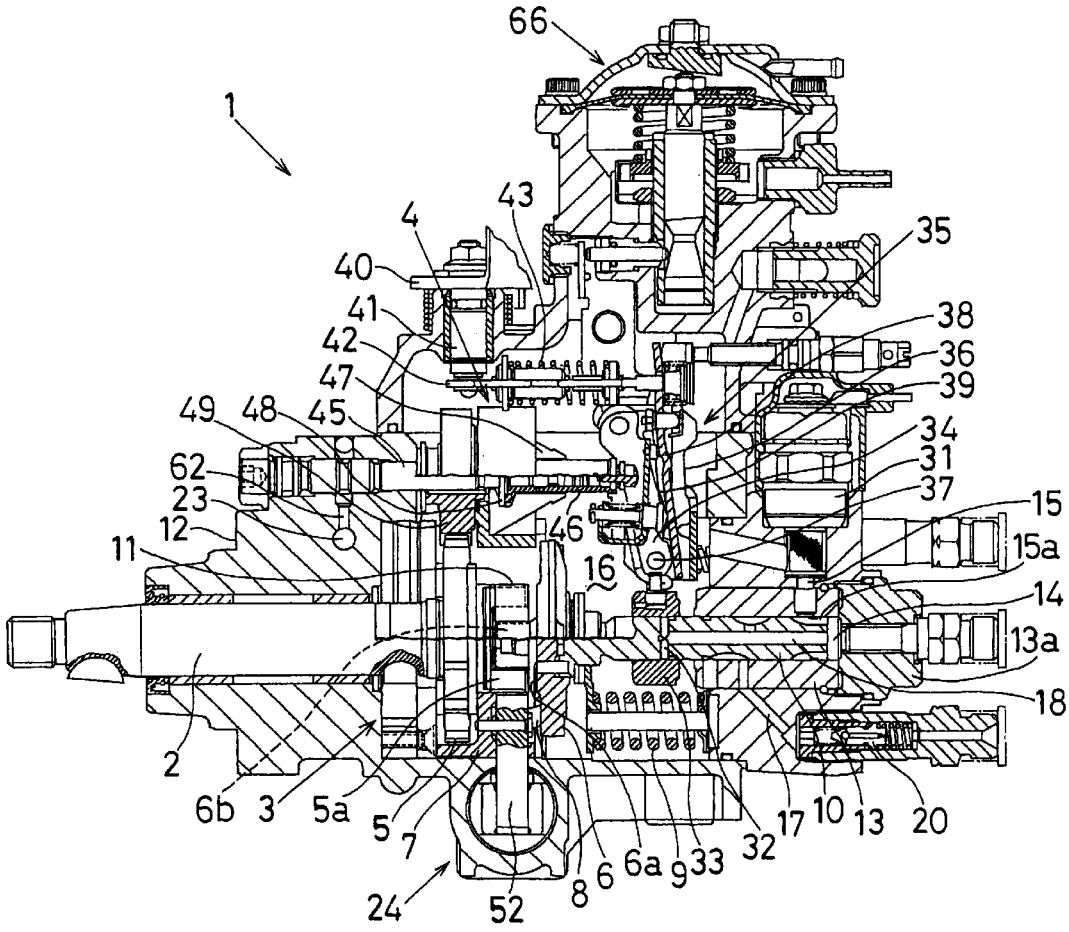
FIG. 4 is a sectional view showing a fuel injection pump according to the embodiment.

At first, referring to FIG. 4, a distribution type fuel injection pump 1 is explained. The injection pump 1 that feeds under pressure fuel to each engine cylinder of a diesel engine (not shown) is equipped with a drive shaft 2 rotatably-driven by the diesel engine. Around the middle of the drive shaft 2, a vane type feed pump 3 is provided and rotatably-driven along with the rotation of the drive shaft 2.

A drive gear 5 is provided in an anchor end of the drive shaft 2 and drives a governor 4. The governor 4 is explained later. A roller ring 7 is disposed between the drive gear 5 and a cam plate 6. The roller ring 7 is equipped with a plurality of cam rollers 8 opposed to cam wheel faces 6*a* of the cam plate 6. The number of the cam wheel faces 6*a* is the same number of the engine cylinders of the diesel engine. The cam plate 6 is pushed upon the cam roller 8 by a spring 9.

The cam plate 6 is equipped with a plunger 10 for fuel pressurization and is rotated together with the drive shaft 2 through a coupling 11. The coupling 11 is formed by inserting a rotation transmission shaft 6*b* provided in the cam plate 6 into a coupling plate 5*a* provided in the drive shaft 2. The cam plate 6 is rotated together with the drive shaft 2. That is, the rotation power of the drive shaft 2 is transmitted to the cam plate 6 via the coupling plate 5*a* and the rotation transmission shaft 6*a*, so the cam plate 6 is rotated with mating with the cam roller 8.

The cam plate 6 is rotated and reciprocates in the horizontal direction in FIG. 4 by the number of the engine cylinders, so the plunger 10 is rotated and reciprocates also in the horizontal direction. That is, the plunger 10 advances (lifts up) during the process in which the cam wheel face 6*a* climbs up the cam roller 8 of the roller ring 7. And it backs (lifts down) during the process in which the cam wheel face 6*a* climbs down the cam roller 8.

A pump housing 12 is provided with a cylinder 13 where the plunger 10 is inserted. A high pressure chamber 14 is formed between the head of the plunger 10 and a head plug 13*a* that forms the bottom of the cylinder 13. The plunger 10 is provided with suction grooves 15*a* whose piece number is the same as the engine cylinders. The suction grooves 15*a* are provided on the outer circumference of the plunger 10 on a side of the head thereof. The suction grooves 15*a* communicate with a pump chamber 16 via a suction port 15 formed in the pump housing 12 when the high pressure chamber 14 is depressurized according to backing of the plunger 10. And fuel in the pump chamber 16 is introduced into the high pressure chamber 14 through the suction groove 15*a*. A distribution port 18 is formed within the plunger 10 on a side of the head thereof and used for pressurized fuel to be introduced into discharge ports 17 formed in the pump housing 12. The discharge ports 17 in the same number of the engine cylinders open to an inside of the cylinder 13 at equal intervals.

A delivery valve 20 is disposed in each exit of the discharge port 17. The delivery valve 20 is used for preventing reversed flow of the fuel fed under pressure to a fuel press-filling pipe (not shown) from the discharge port 17. When pressure of the fuel press-fed into the discharge port 17 reaches a specified value, the delivery valve 20 opens and introduces it into the fuel press-filling pipe.

The pump housing 12 is also equipped with an inlet (not shown) communicating with a fuel tank (not shown) . The inlet is connected with a suction side of the feed pump 3 via an introduction port 23 which corresponds to a low fuel pressure side. The introduction port 23 also communicates with an inner pressure chamber 25 of a timer apparatus 24 to be described later.

The pump chamber 16 is formed within the pump housing 12 and supplied with the fuel from the feed pump 3. The pump chamber 16 stores the fuel that is sucked into the above high pressure chamber 14. And it fills up the fuel into sliding mechanically-contact portions of the plunger 10, the cylinder 13 and so on.

The feed pump 3 is rotatably-driven by the drive shaft 2 and sucks the fuel from the fuel tank through the inlet into an introduction port 23. The sucked fuel is then fed under pressure into a delivery port (not shown) and fed to the pump chamber 16.

In the suction process in which the plunger 10 backs and the high pressure chamber 14 is depressurized, one of the suction grooves 15*a* communicates with the pump chamber 16 via the suction port 15. And the fuel in the pump chamber 16 is sucked into the high pressure chamber 14. In the pressurizing process, the plunger 10 advances and the high pressure chamber 14 is pressurized. In this process, the fuel pressurized in the high pressure chamber 14 is fed into a fuel injection nozzle (not shown) through the discharge port 17, the delivery valve 20 and the fuel press-filling pipe (not shown). When the pressure of the fed fuel reaches a nozzle opening pressure, the fuel injection nozzle injects the fuel into the engine cylinder.

A spill electromagnetic valve 31 is disposed in the middle of the suction port 15. It regulates a flow amount of the fuel fed from the high pressure chamber 14 to the discharge port 17 by opening the suction port 15 and spilling a part of the fuel into the pump chamber 16. The valve 31 is a normally open valve. When current is not supplied (current-off), the valve 31 opens the suction port 15 so that the fuel pressurized in the high pressure chamber 14 can be spilt into the pump chamber 16 via the suction port 15. On the other hand, when the current is supplied to the valve 31 (current-on), the valve 31 closes the suction port 15 so that the fuel spilt into the pump chamber 16 can be shut off.

The valve 31 thus controls opening and closing of the suction port 15 by the current on/off control to regulate the spilling fuel from the high pressure chamber 14 to the pump chamber 16. When the valve 31 opens in the pressurizing process of the plunger 10, the high pressure chamber 14 is depressurized to terminate the fuel injection. Namely, even if the plunger 10 advances, the high pressure chamber 14 is not pressurized as for as the valve 31 opens. The fuel injection is thereby not performed. The timing of opening the valve 31 is controlled while the plunger 10 advances, so timing of the fuel injection is controlled and an amount of the fuel injection to the cylinder is controlled.

A spill port 32 is formed in the plunger 10. One end of the spill port 32 is connected with the distribution port 18 and the fuel pressurized in the high pressure chamber 14 is spilt into the pump chamber 16 through the spill port 32. The other end of the spill port 32 opens within the pump chamber 16 and a ring shaped spill ring 33 is joined around the plunger 10 to open/close the spill port 32. In addition, the spill ring 33 is slidably fitted to the outer circumference of the plunger 10 and is set at a position corresponding to a rotation point of a control lever 34, as described later. When the spill port 32 is moved rightward in FIG. 4, an amount of the fuel injection increases. When it is moved leftward, the amount decreases. That is, when the spill port 32 is exposed from the spill ring 33, the fuel injection terminates.

The position of the spill ring 33 is set to correspond to the rotation point of the control lever 34 of a lever assembly 35. The lever assemble 35 includes a guide lever 36 whose rotating position is set relatively to the pump housing 12, a tension lever 38 and the control lever 34. The tension lever 38 is equipped rotatably about a supporting axis 37 of the guide lever 36.

The control lever 34 contacts the tension lever 38 via a start spring 39. The start spring 39 is bent except for engine start timing, so the control lever 34 is rotated about the supporting axis 37 together with the tension lever 38. The lower end of the control lever 34 is mated with the spill ring 33. When the control lever 34 is rotated counterclockwise in FIG. 4, the spill ring 33 is moved rightward and the amount of the fuel injection increases. When the control lever 34 is rotated clockwise in FIG. 4, the spill ring 33 is moved leftward and the amount of the fuel injection decreases.

An adjusting lever 40 (accelerator lever) is provided in the pump housing 12 via an axis 41. It is freely rotated to give operation force to the tension lever 38. An eccentric pin 42 is provided in one end of the axis 41 that protrudes within the pump chamber 16. A control spring 43 is located between the eccentric pin 42 and the tension lever 38 to draw the tension lever 38 counterclockwise in FIG. 4. The tension of the control spring 43 increases as the adjusting lever 40 is turned to the fuel increasing side, and decreases as the adjusting lever 40 is turned to the fuel decreasing side.

The control lever 34 is operated by a governor 4 in use of centrifugal force. The governor 4 includes a governor shaft 45, a governor sleeve 46 and a fly weight 47. The governor shaft 45 is fixed to the pump housing 12 to protrude within the pump chamber 16. The governor sleeve 46 is slidably fitted to the outer circumference of the governor shaft 45. One end of the governor sleeve 46 contacts the control lever 34 and the other end contacts the fly weight 47 via a washer 48. The governor sleeve 46 advances axially (rightward in FIG. 4) as the fly weight 47 opens, while it backs axially (leftward in FIG. 4) as the fly weight 47 closes. The fly weight 47 is rotatably-driven by a driven gear 49 driven by the drive gear 5 rotatable together with the drive shaft 2. The fly weight 47 opens and closes due to centrifugal force of its rotation.

As explained above, rotating positions of the control lever 34 and the tension lever 38 are determined by balancing of biasing forces between the control spring 43 and the governor sleeve 46. A position of the spill ring 33 is then determined and the fuel injection amount is regulated.

Namely, under the state in which the tension of the control spring 43 is maintained in a certain value, when rotating velocity of the drive shaft 2 is increased, the fly weight 47 opens by the strengthened centrifugal force and the governor sleeve 46 advances. The control lever 34 is turned clockwise in FIG. 4 against the control spring 43 and the spill spring 33 moves leftward in FIG. 4. The fuel injection amount is thereby decreased. By contrast, when rotating velocity of the drive shaft 2 is decreased, the fly weight 47 closes by the weakened centrifugal force and the control spring 43 turns the control lever 34 counterclockwise in FIG. 4. Accordingly, the spill spring 33 moves rightward in FIG. 4 and the fuel infection amount is thereby increased.

On the other hand, under the state in which the rotating velocity of the drive shaft 2 is maintained at a certain value, when the adjusting lever 40 turns to the fuel increasing side, the tension of the control spring 43 is increased. So, the control lever 34 turns counterclockwise in FIG. 4, the spill ring 33 moves rightward and the fuel injection amount is thereby increased. Here, the governor sleeve 46 backs along with the turn of the control lever 34 and the fly weight 47 closes in correspondence with backing of the governor sleeve 46. In contrast, when the adjusting lever 40 turns to the fuel decreasing side, the tension of the control spring 43 is decreased. The biasing force of the governor sleeve 46 thereby becomes relatively stronger than that of the control lever 34. The control lever 34 turns clockwise, the spill ring 33 moves leftward and the fuel injection amount is thereby decreased.

The timer apparatus 24 is provided in the bottom of the pump housing 12 and is used for regulating to advance or delay the fuel injection timing according to the pressure within the pump chamber 16. The timer apparatus 24 changes an angular position of the roller ring 7 relative to the drive shaft 2 in the turning direction thereof. And the timer apparatus 24 thereby changes the timing when the cam wheel face 6*a* climbs up and down the cam roller 8, namely the timing of advancing and backing of the plunger 2.

Figure 5:
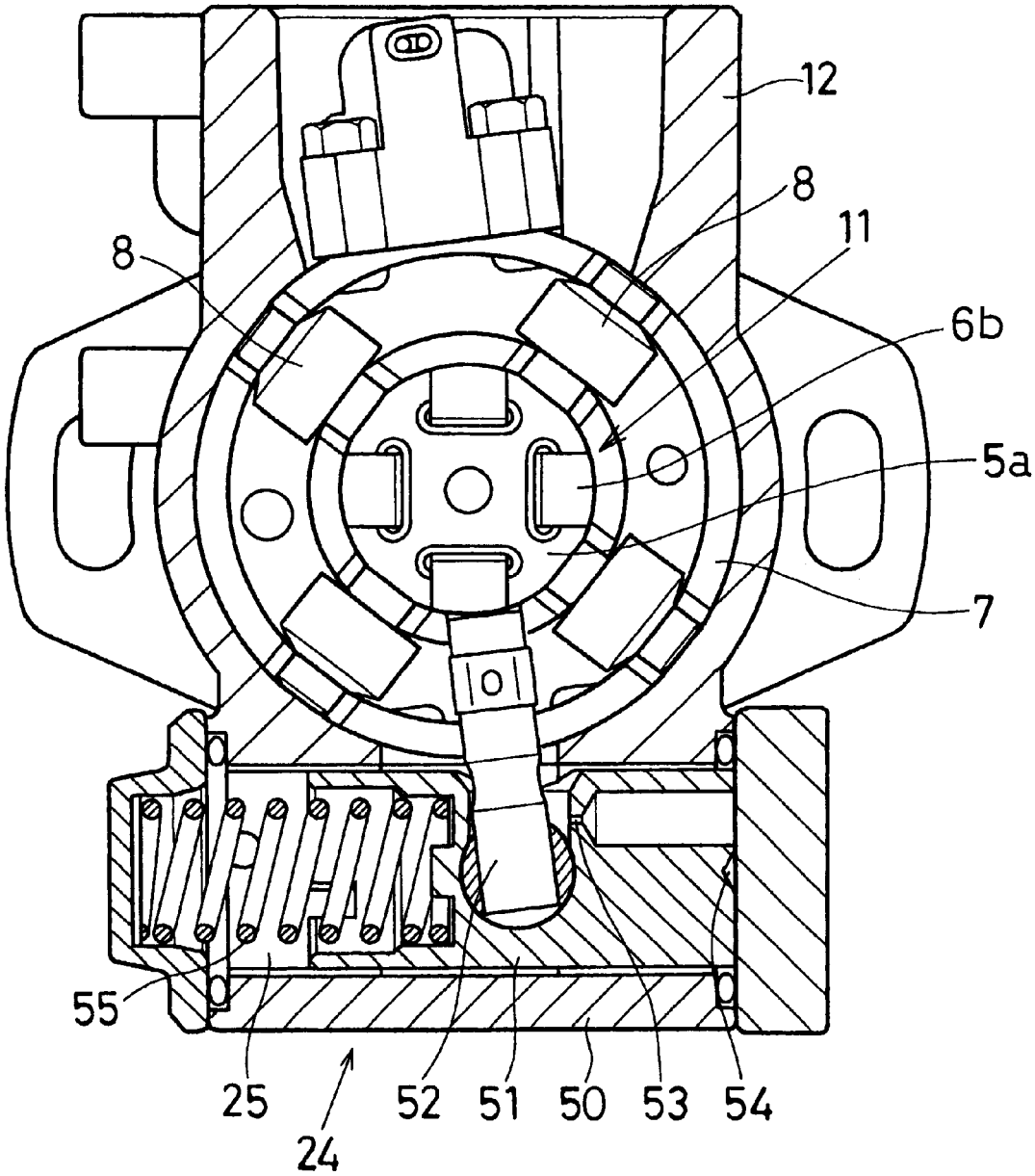
FIG. 5 is a sectional view showing a timer apparatus of a fuel injection pump according to the embodiment.

As shown in FIG. 5, the timer apparatus 24 includes a timer housing 50 and a timer piston 51 that is joined to move axially within the timer housing 50. The timer piston 51 is connected with the roller ring 7 via a slide pin 52. One end of the timer piston 51 forms the inner pressure chamber 25 to which the fuel discharge pressure of the feed pump 3 is applied. The other end forms a pressurizing chamber 54 to which the fuel pressure of the pump chamber 16 is applied via an orifice 53 that prevents pulse beat of the fuel.

In the inner pressure chamber 25 of the timer apparatus 24, the fuel pressurized by the feed pump 3 is introduced and a timer spring 55 is provided. The timer spring 55 biases the timer piston 51 toward the pressurizing chamber 54. The position of the timer piston 51 is determined by balancing among the fuel pressure introduced into the inner pressure chamber 25, the biasing force of the timer spring 55 and the pressure of the pressurizing chamber 54. The position of the roller ring 7 is determined by determining the position of the timer piston 51 and the timing of advancing and backing of the plunger 10 is thereby determined.

In particular, in the timer apparatus 24, when the pressure of the pump chamber 16 is high, the timer piston 51 moves in the direction to the inner pressure chamber 25 against biasing force of the timer spring 55 to turn the roller ring 7 so that the fuel injection timing can advance. In contrast, when the pressure of the pump chamber 16 is low, the timer piston 51 moves in the direction to the pressurizing chamber 25 due to the biasing force of the timer spring 55 to turn in reverse the roller ring 7 so that the fuel injection timing can retard.

In the fuel injection pump 1, an inverse characteristic load timer is provided using the above timer apparatus 24. This characteristic exhibits that the timing retards while the engine load is high and the timing advances while the engine load is low. To attain the inverse characteristic load timer, an inside way-out 56 and an outside way-out 57 are provided in the governor shaft 45 and governor sleeve 46 of the governor 45.

Figure 1A:
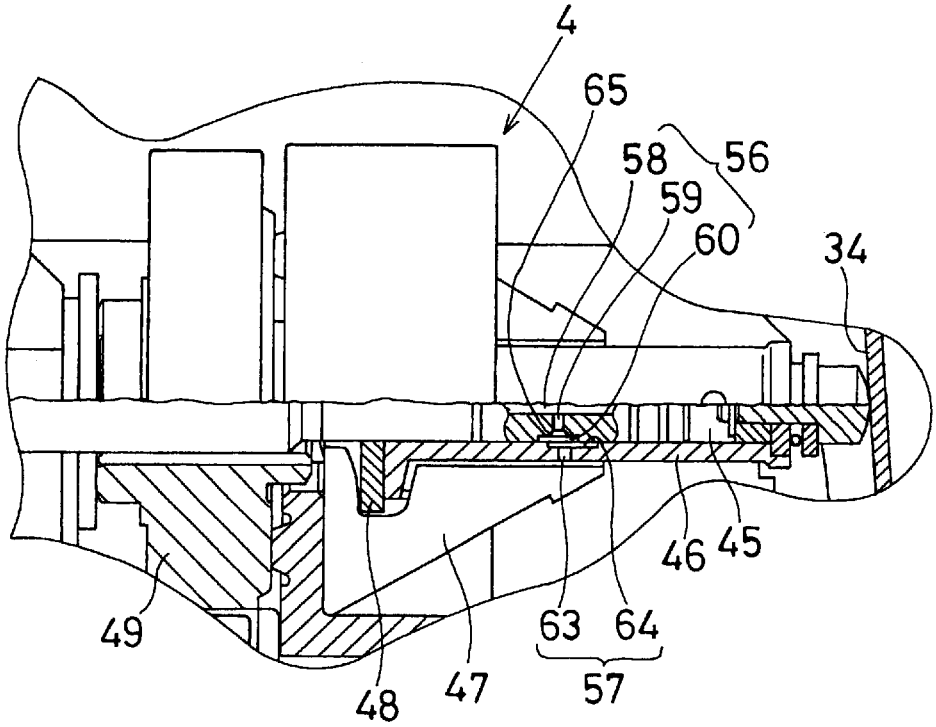
FIG. 1A is a sectional view of a governor of a fuel injection pump according to an embodiment of the present invention.
Figure 1B:
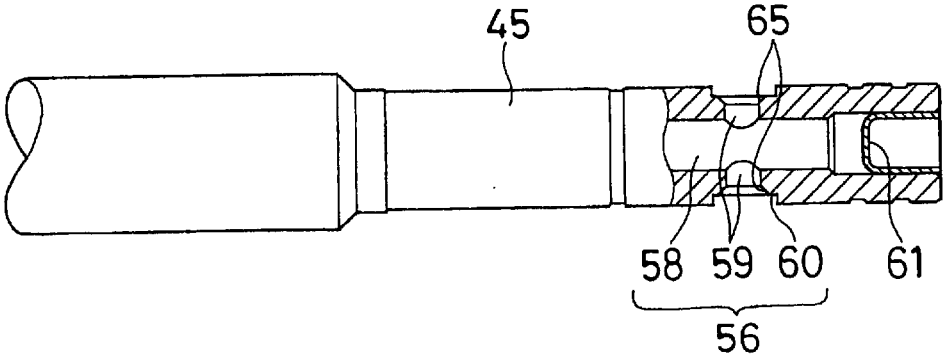
FIG. 1B is a sectional view of a governor shaft of the governor according to the embodiment.

Referring to FIGS. 1A and 1B, the inside and outside way-outs 56, 57 are explained. The inside way-out 56 formed in the governor shaft 45 includes a first shaft port 58, a second shaft port 59 and an annular groove 60. The first shaft port 58 is formed in the center of the governor shaft 45. The second shaft port 59 extends in a radial direction of the governor shaft 45 across the first shaft port 58. The port inlet of the second shaft port 59 opens in the bottom of the annular groove 60. The end of the first shaft port 58 is sealed by a plug 61. The other anchor end is connected with the introduction port 23 through a low pressure port 62 formed in the pump housing 12. The introduction port 23 is located at the suction side of the feed pump 3 that corresponds to a low pressure fuel side.

The outside way-out 57 is formed in the governor sleeve 46 to face the governor shaft 45. The outside way-out 57 includes a sleeve port 63 that penetrates through the governor sleeve 46, and an annular groove 64 that is formed in an inside circumference of the governor sleeve 46. The sleeve port 63 opens in the bottom of the annular groove 64. The outside way-out 57 is arranged to communicate with the inside way-out 56 when the governor sleeve 46 backs and not to communicate with the inside way-out 56 when the governor sleeve 46 advances.

An operation of the inverse characteristic load timer is explained under the state in which an engine rotation velocity is maintained at a certain value. When the adjusting lever 40 turns to the fuel increasing side with increasing engine load, the tension of the control spring 43 increases and the control lever 34 turns counterclockwise in FIG. 4. Then the governor sleeve 46 backs and makes the fly weight 47 close with the turning of the control lever 34. As the inside and outside way-outs 56, 57 communicate with each other as shown in FIG. 1A, the fuel of the pump chamber 16 is introduced to the introduction port 23 (low pressure fuel side) that is at the suction side of the feed pump 3 via the inside and outside way-outs 56, 57. As a result, the pump chamber 16 is depressurized and the timer apparatus 24 retards the fuel injection timing.

In contrast, when the adjusting lever 40 turns to the fuel decreasing side with decreasing engine load, the tension of the control spring 43 decreases. The force of the fly weight 47 for advancing the governor sleeve 46 thereby relatively increases and the control lever 34 turns clockwise in FIG. 4. Then, the governor sleeve 46 advances and the communication between the inside and outside way-outs 56, 57 is shut off. Therefore, the fuel of the pump chamber 16 flowing to the introduction port 23 via the inside and outside way-outs 56, 57 is shot off. As a result, the pump chamber 16 is pressurized and the timer apparatus 24 advances the fuel injection timing.

Figure 2A:
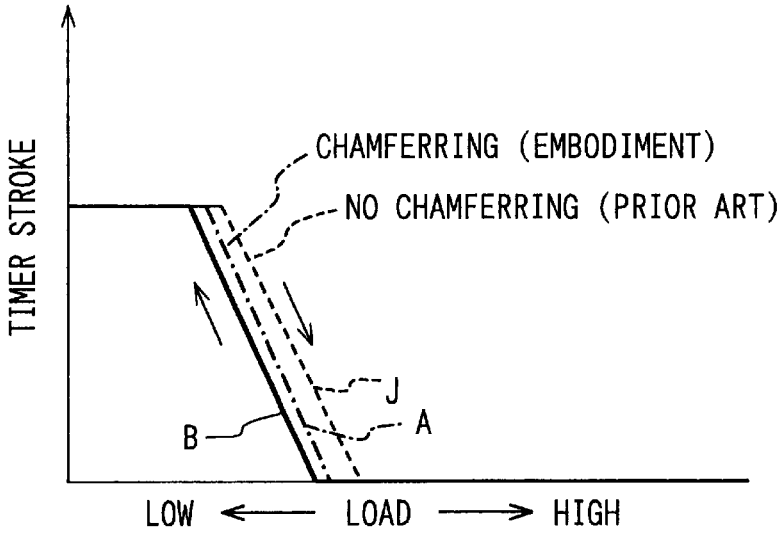
FIG. 2A is a graph showing inverse advancing and retarding characteristics of a load timer according to the embodiment and a prior art.
Figure 2B:
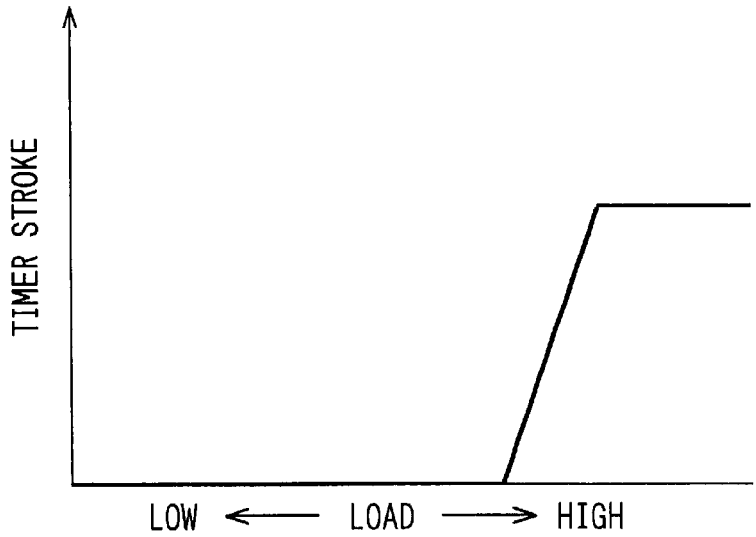
FIG. 2B PRIOR ART
FIG. 2B is a graph showing an advancing and retarding characteristic of a load timer according to another prior art.

The above operation provides an advancing and retarding characteristic shown in FIG. 2A, in which the timing is advanced at the fuel injection amount decreasing side (low load side) and retarded at the fuel injection amount increasing side (high load side).

In the fuel injection pump 1 having the inverse characteristic load timer according to the present embodiment, switching between advancing and retarding timings is performed in a high rotation range. The switching is therefore executed in the state in which the discharge fuel pressure of the feed pump 3 driven by the drive shaft 2 is high, i.e., the fuel pressure of the pump chamber 16 is high.

It means that when the advancing timing is changed to the retarding timing, the fuel pressure of the pump chamber 16 is high. The fuel therefore passes through the inside and outside way-outs in higher flow velocity in comparison with the state in which the fuel pressure of the pump chamber 16 is low.

The switchings from the advancing timing to the retarding timing and from the retarding timing to the advancing timing are executed when flow velocity of the fuel passing through both of the inside and outside way-outs communicating with each other is high. As shown in FIG. 2A, there exists a hysteresis between a characteristic diagram for switching from the advancing timing to the retarding timing according to increase of the load and a characteristic diagram for switching from the retarding timing to the advancing timing according to decrease of the load. The hysteresis is larger as the fuel velocity of the fuel passing through the inside and outside way-outs more increases.

In the present embodiment, a chamfering/rounding portion 65 is formed in the port inlet of the second shaft port 59 that opens to the annular groove 60 as shown in FIG. 1B. The chamfering/rounding portion 65 is formed by cutting off in flat or rounding the corner thereof.

Figure 3A:
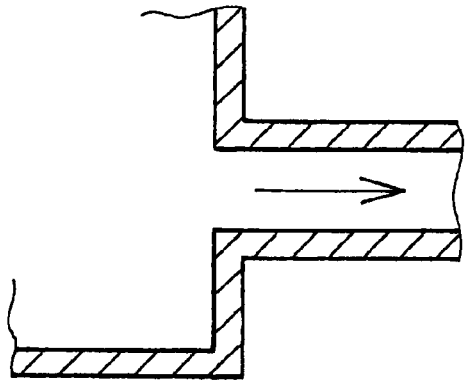
FIG. 3A PRIOR ART
FIG. 3A is a diagrammatic view showing an inlet structure of an inside way-out according to the prior art.
Figure 3B:
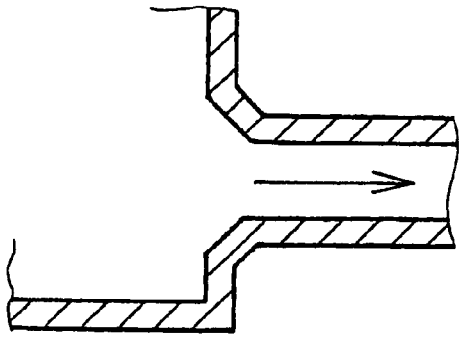
FIGS. 3B and 3C are diagrammatic views showing inlet structures of an inside way-out according to the embodiment.
Figure 3C:
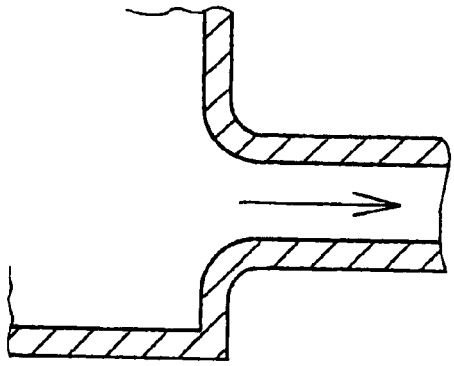

A loss coefficient is 0.5 in the state where no chamfering/rounding portion is formed in the port inlet of the second shaft port 59 as shown in FIG. 3A. In contrast, the loss coefficient is decreased by 50% to 0.25 with cutting off in flat the corner shown in FIG. 3B and decreased remarkably to 0.06 (at smaller round) to 0.005 (at larger round) with rounding the corners.

As explained above, forming the chamfering/rounding portion 65 in the port inlet of the inside way-out 56 enables the loss coefficient to be decreased. The energy loss generated from the fuel flowing in the inside way-out 56 is smaller in comparison to that in the prior art and the flow characteristic of the fuel flowing into the inside way-out 56 is enhanced.

Enhancement of the flow characteristic results in lowering the hysteresis between the depressurization of the pump chamber 16 while the load increases and the pressurization of the pump chamber 16 while the load decreases.

In particular, referring to FIG. 2A, a dotted line J shows a retarding characteristic with increasing the load without any chamfering/rounding in the port inlet of the inside way-out 56 in a prior art. A solid line B shows an advancing characteristic with decreasing the load. With chamfering/rounding in the port inlet, the retarding characteristic is shown in a dot/slash line A. Thereby, a hysteresis between the line A and the solid line B showing the advancing characteristic with decreasing the load is smaller compared with the hysteresis between the lines J and B. The smaller hysteresis achieves the fuel injection pump 1 to be controlled by highly accurate fuel injection timing.

The above embodiment is explained as being applied to a fuel injection pump 1 that is equipped with a high-compensating device 66 as shown in FIG. 4. Here, the high-compensating device 66 is capable of automatically decreasing a full load fuel injection amount with decreasing air pressure. However, the invention can be applied to a fuel injection pump without the high-compensation device 66.

What is claimed is:

1. A distribution type fuel injection pump including a pump chamber, a feed pump that feeds fuel to the pump chamber, a timer apparatus that advances and retards fuel injection timing according to increase and decrease of fuel pressure in the pump chamber, and a governor having a fly weight, a governor shaft, a governor sleeve whose inner surface is slidably fitted to an outer circumference of the governor shaft, and a fluid passage formed in the governor shaft and the governor sleeve, through which communication between a suction side of the pump and the pump chamber is allowed or interrupted according to back and forth axial movement of the governor sleeve relative to the governor shaft based on closing and opening of the fly weight, the fluid passage comprising:

an inside way-out including a first shaft port axially extending in a center of the governor shaft, one end of the first shaft port communicating with the suction side of the pump and the other end of the first shaft port being sealed, an annular groove formed on the outer circumference of the governor shaft to face the inner surface of the governor sleeve, and a second shaft port extending in a radial direction of the governor shaft from the first shaft port to a bottom of the annular groove, a corner of the second shaft port opening to the bottom of the annular groove being provided with one of a chamfering portion formed by cutting off flatly the corner and a rounding portion formed by rounding the corner; and an outside way-out whose one end opens to the inner surface of the governor sleeve to face the outer circumference of the governor shaft and whose the other end opens to an outer surface of the governor sleeve to communicate with the pump chamber, wherein, according to the back and forth axial movement of the governor sleeve, the fuel pressure in the pump chamber increases when the communication between the inside and outside way-outs is shut off and decreases when the inside and outside way-outs communicate with each other.

* * * * *